US007030564B2

(12) United States Patent
Hilscher et al.

(10) Patent No.: US 7,030,564 B2
(45) Date of Patent: Apr. 18, 2006

(54) LOW-PRESSURE DISCHARGE LAMP

(75) Inventors: Achim Hilscher, Friedberg-Stätzling (DE); Thomas Noll, Kipfenberg (DE)

(73) Assignee: Patent-Treuhand-Gesellschaft für Elektrische Glühlampen mbH, Munich (DE)

( * ) Notice: Subject to any disclaimer, the term of this patent is extended or adjusted under 35 U.S.C. 154(b) by 38 days.

(21) Appl. No.: 10/778,156

(22) Filed: Feb. 17, 2004

(65) Prior Publication Data

US 2004/0160182 A1 Aug. 19, 2004

(30) Foreign Application Priority Data

Feb. 17, 2003 (DE) ..... 103 06 584

(51) Int. Cl.
*H01J 17/44* (2006.01)

(52) U.S. Cl. ..... 313/594; 313/595; 313/601; 313/493; 313/634

(58) Field of Classification Search ..... 313/595, 313/594, 601, 493, 634
See application file for complete search history.

(56) References Cited

U.S. PATENT DOCUMENTS

| | | | | |
|---|---|---|---|---|
| 4,508,993 | A * | 4/1985 | Anderson | 315/59 |
| 4,853,591 | A * | 8/1989 | Klein et al. | 313/493 |
| 6,064,152 | A | 5/2000 | Hammer et al. | |
| 6,437,502 | B1 * | 8/2002 | Nishio et al. | 313/493 |
| 6,614,166 | B1 | 9/2003 | Hilscher et al. | |

FOREIGN PATENT DOCUMENTS

| | | |
|---|---|---|
| WO | WO 01/87019 | 11/2001 |

* cited by examiner

*Primary Examiner*—Mariceli Santiago
*Assistant Examiner*—Anthony T. Perry
(74) *Attorney, Agent, or Firm*—Carlo S. Bessone

(57) ABSTRACT

A low-pressure discharge lamp is described having a base housing (10), a discharge vessel (2), whose end sections are fixed to an end section of the base housing, and a contact-making system for making electrical contact with the lamp, which is located on the end section of the base housing (10) which is remote from the discharge vessel, a conductive section (5) being provided, which is electrically connected to the contact-making system and is arranged adjacent to the discharge vessel (2) in the base housing (10) in such a way that an electrical short circuit is formed around the discharge vessel (2). This makes it possible to reduce the starting voltage of the lamp. As an alternative, or in addition, to this, the cross section of the web attachments is increased, which also increases the rate of the luminous-flux run-up.

15 Claims, 2 Drawing Sheets

LOW-PRESSURE DISCHARGE LAMP

TECHNICAL FIELD

The present invention relates to a low-pressure discharge lamp having a base housing, a wound, tubular discharge vessel, whose end sections are fixed to an end section of the base housing, and a contact-making system for making electrical contact with the lamp, which is located on the end section of the base housing which is remote from the discharge vessel.

The present invention further relates to a low-pressure discharge lamp having a base housing, a discharge vessel, whose end sections are fixed to the base housing, and which has at least two U-shaped subelements and a web attachment, or a discharge vessel, whose end sections are fixed to the base housing, and which has at least three U-shaped subelements and two web attachments, the web attachment(s) being provided for connecting an end section of one of the U-shaped subelements to an end section of the next one of the U-shaped subelements in such a way that a continuous discharge path is formed in the subelements.

BACKGROUND ART

Such low-pressure discharge lamps are produced by the company OSRAM, for example under the designations DULUX D/E, T/E, T/E IN. To be more precise, the above-mentioned lamps are compact low-pressure discharge lamps having a discharge vessel comprising at least four straight, parallel tubes, which are arranged in a polygon and are connected by means of cross connections at or close to the end sections of the straight tubes to form a single continuous and gas-tight discharge path.

Depending on the length and the diameter of the discharge vessel and of the diameter of the cross connections of the discharge tubes, very high voltages are often required to start the low-pressure discharge lamp.

The patent specification U.S. Pat. No. 6,614,166 discloses a low-preassure discharge lamp in which a metallic helical spring which runs parallel to the straight tubes is arranged in the center of the cylindrical cavity formed by the straight tubes of the discharge vessel in order to reduce the starting voltage, and, at the same time, to allow the light, which is radiated inwards into the cavity formed by the straight tubes and the cross connections of the discharge vessel, to pass, only slightly impeded.

The U.S. Pat. No. specification 6,064,152 discloses the use of a hollow cylinder made from electrically conductive material in the form of a metal foil in the interior formed by the straight, parallel tubes of the discharge vessel, as a result of which the starting voltage can be considerably reduced.

The disadvantage of said prior art is that the helical spring from U.S. Pat. No 6,614,166 and the metallic cylinder from the U.S. patent can be seen from the outside and impede the luminous flux.

WO 01/87019 discloses a fluorescent lamp, in which a starting aid is connected, on the one hand, to the base and, on the other hand, is in contact, in the form of a spring, with a limb of the discharge vessel without an electrode.

DISCLOSURE OF THE INVENTION

The object of the present invention is to eliminate the disadvantages of the prior art, and to provide a lamp with a reduced starting voltage, in which the luminous flux of the lamp from the discharge vessel is not influenced. In addition, it should be possible to assemble the lamp according to the invention in a simple manner.

For a low-pressure discharge lamp of the above-described type having a base housing, a discharge vessel and a contact-making system, this object is achieved by an electrically conductive section with an electrical short circuit around a subsection of the discharge vessel or around the entire discharge vessel in the base housing, this short circuit being electrically connected to the contact-making system (electrode holder or contact pin). This makes it possible to reduce the starting voltage of the lamp, preferably if the lamp is operated with a high-frequency AC voltage (≧20 kHz), as provided, for example, by an electronic ballast.

The electrically conductive section is preferably a wire, which makes it possible to reduce the starting voltage in a simple manner and without impairing the luminous flux of the lamp.

The wire is preferably self-contained and electrically conductively connected to the electrode holder (one of the four power supply wires or one of the contact pins connected to the lamp fitting). Assembly may be simplified either by using the inner circumference of the base housing or the inner circumference of the glass tubes forming the discharge vessel. In this case, the starting voltage is generally reduced to a greater extent the closer the wire is to the discharge vessel, meaning the ends of the glass tubes forming the discharge vessel which project into the base housing for fixing purposes.

The distance between the plane which is formed by the electrode filaments, and the plane which is formed by the wire ring, meaning in each case the plane perpendicular to the longitudinal axis of the lamp, has a more pronounced effect on the reduction of the starting voltage than the "lateral" distance between the wire and the glass tubes. The smaller the distance between these two planes is, the more the starting voltage can be reduced.

As an alternative to this, the wire may also be guided around the lamp in a wavy line, that is one which goes in and then out, on the discharge tube.

To facilitate production, a metal ring, for example in the form of a washer, may be introduced instead of a wire into the lamp base, and said metal ring is connected to a power supply.

As an alterative to the wire ring, a conductive layer in the form of a metal foil, such as an aluminum foil, or in the form of an electrically conductive powder, preferably ferrous powder, may also be provided, which is embedded in the cement composition of the base housing. The electrically conductive powder may also be sprinkled onto the cement composition of the base housing prior to heating. These measures also result in a reduction in the starting voltage.

The discharge vessel has two, preferably three, U-shaped subelements, whose end sections are connected to one or two web attachments to form a continuous discharge path. The cross section of these web attachments is optimized with respect to the tube diameter of the discharge vessel so that a minimum starting voltage is required for starting the lamp. This alternative or additional measure for forming the conductive section not only reduces the starting voltage but also accelerates the luminous-flux build-up and reduces the temperature in the base housing.

By bringing the two ends of the lamp closer together, the starting voltage may likewise be reduced.

The present invention can be used for tubular discharge vessels having any form of winding in low-pressure discharge lamps, in particular compact fluorescent lamps, preferably for discharge vessels comprising two or three U-shaped subelements, in particular if they are operated using ballasts at a frequency ≧20 kHz.

BRIEF DESCRIPTION OF THE DRAWINGS

Preferred exemplary embodiments of the invention are explained below with reference to schematic drawings, in which.

BEST MODE FOR CARRYING OUT THE INVENTION

Figure 1:
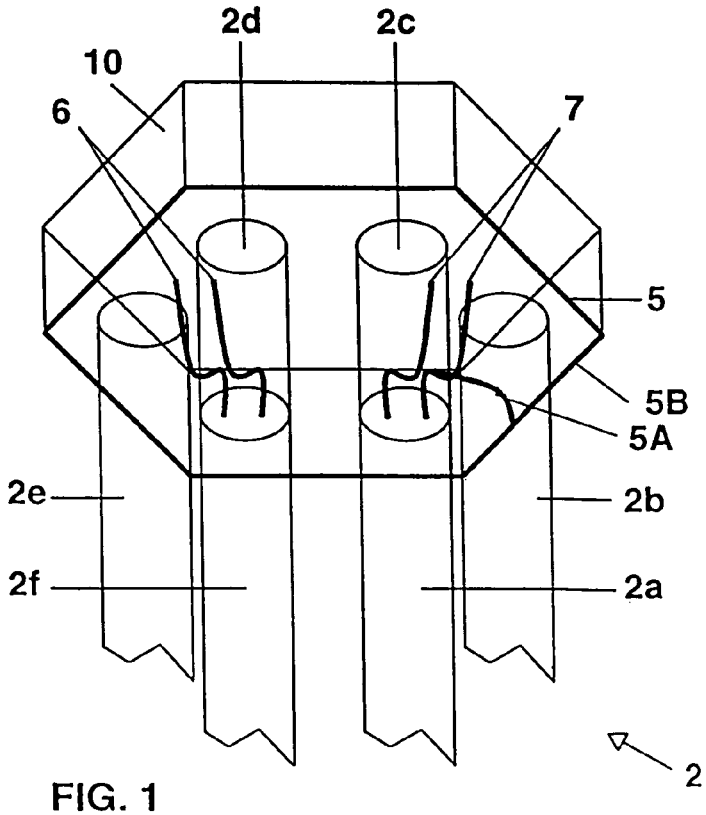
FIG. 1 shows a schematic partial section through a low-pressure discharge lamp according to the invention corresponding to the first exemplary embodiment.
Figure 4:
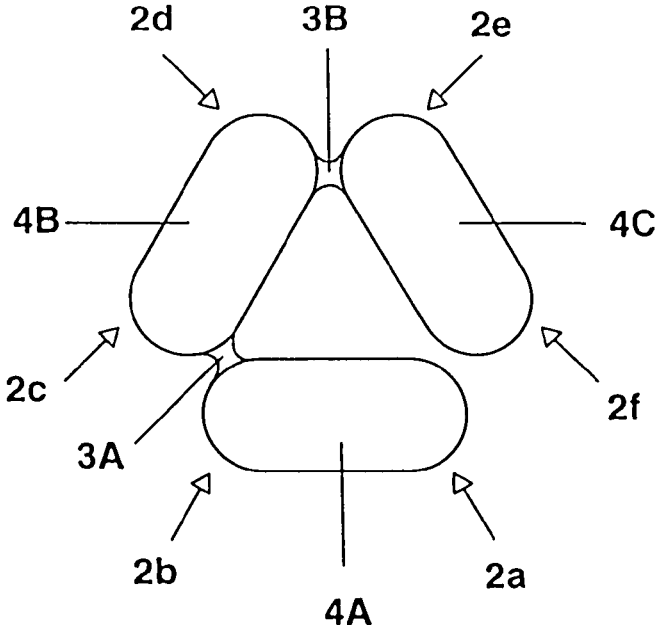
FIG. 4 shows an illustration of the structure of the discharge vessels corresponding to the present invention.

FIG. 1 shows, schematically, a perspective view of a partial section through a low-pressure discharge lamp according to the invention, whereas FIG. 4 shows the view from below of the low-pressure discharge lamp with respect to the representation in FIG. 1.

This type of low-pressure discharge lamp shown has a glass discharge vessel 2, which has six tubes 2*a*–2*f*, which are arranged parallel to one another in their longitudinal directions, and which is provided on an end section of a base housing 10 (see FIG. 1). The tubes 2*a*–2*f* form, together with cross connections 4A, 4B, 4C and attachment pieces 3A, 3B (see FIGS. 3, 4), a continuous discharge path. The inner wall of the discharge vessel 2 is provided with a fluorescent coating.

In each case two of the tubes 2*a*–2*f*, more precisely the tubes 2*a* and 2*b*, the tubes 2*c* and 2*d* and the tubes 2*e* and 2*f*, are each connected to one another by one of the cross connections 4A, 4B, 4C shown in FIG. 4. The cross connections 4A, 4B, 4C are located on the end sections of the tubes 2*a*–2*f*, which are provided opposite the end section of the tubes in the base housing. The tubes 2*b* and 2*c*, and 2*d* and 2*e* are connected at the end sections in the base housing 10 by the web attachments 3A and 3B (see FIG. 4). In each case two adjacent tubes, that is the tubes 2*b* and 2*c*, 2*d* and 2*e*, and 2*a* and 2*f*, form the corners of a preferably equilateral triangle.

The free ends of the tubes 2*a* to 2*f*, which are opposite the cross connections 4A and 4C, are sealed off in a gas-tight manner, and are held by means of the base housing 10. Electrode holders 6, 7 are sealed into the two ends of the tube sections 2*a* and 2*f* of the discharge vessel.

The base housing 10 has, on its end section opposite the discharge vessel 2, a contact-making system (not shown), which makes the contact between the electrode holders 6, 7 and the outside and is preferably in the form of a pin base.

According to the first exemplary embodiment shown in FIG. 1, an electrically conductive wire 5 is introduced on the inner circumference of the base housing 10 adjacent to the base cement or into said base cement. In this case, the wire is arranged in such a way that an electrical short circuit is essentially formed around the discharge vessel 2. In this case, the wire 5 has a connecting section 5A, which electrically connects said wire 5 to one of the electrode holders 6, 7, and which is in contact with the opposite end section 5B of the wire. However, the invention is not restricted to this embodiment, rather the connecting section 5A and the end section 5B may alternatively be spaced apart from one another, which gives the same effect according to the invention.

Figure 2:
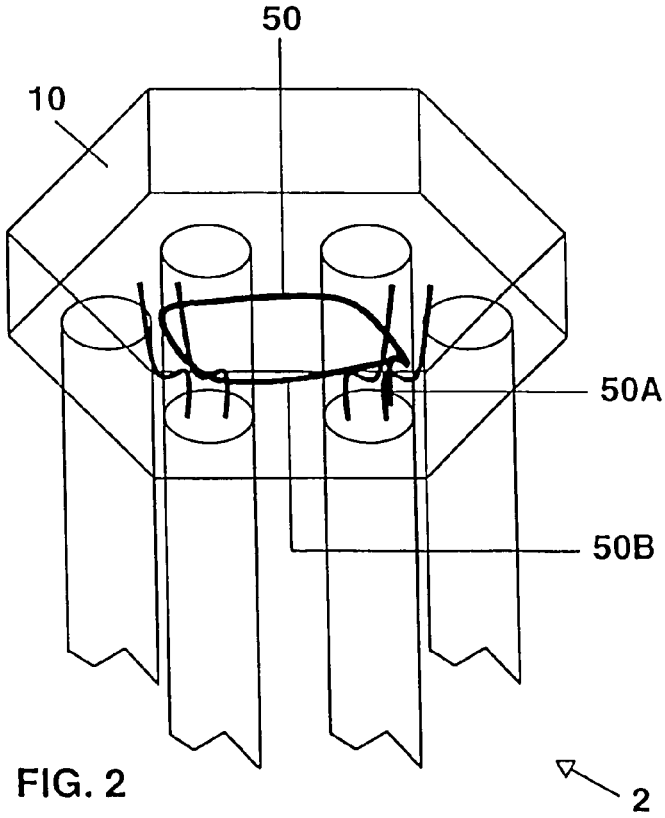
FIG. 2 shows a schematic partial section through a low-pressure discharge lamp according to the invention corresponding to the second exemplary embodiment.

The second exemplary embodiment corresponding to the present invention is shown in FIG. 2 and has, in contrast to the wire 5 from the first exemplary embodiment, a wire 50, which is provided on the inner circumference of the tubes of the discharge vessel 2. The wire 50 has a connecting section 50A, resting on an electrode holder, and an end section 50B, which is in contact with the connecting section 50A. However, the invention is not restricted to this embodiment, and, in fact, the connecting section 50A and the end section 50B may alternatively be spaced apart from one another, which gives the same effect according to the invention.

The wire rings 5 and 50 corresponding to the first and second exemplary embodiments reduce the starting voltage of the low-pressure discharge lamp without the starting aid being visible from the outside and influencing the luminous flux of the lamp, as was the case in the prior art from the U.S. Pat. No. 6,064,152.

Since only a section of the wire 5 and 50 is to be connected to an electrode holder, fitting is considerably easier than when using base-integrated starting aids according to the prior art.

For example, in the case of a low-pressure discharge lamp OSRAM DULUX T/E 32W and a wire 5 corresponding to the first exemplary embodiment, the starting voltage could be reduced from 640 V, when there is no wire 5 provided on the inner circumference of the base housing 10, to 550 V.

In measurements with a mercury-free low-pressure discharge lamp OSRAM DULUX T/E 42W it was established that the wire 50 on the inside of the discharge tubes has approximately twice as much an effect on the reduction of the starting voltage as the wire 5 in the inner edge of the base housing 10. The inventor considers the reason for this effect to be the fact that a smaller distance between the discharge channel and the wire 50 (inner ring) favors a reduction of the starting voltage.

The present invention is not restricted to applications using lamps with six tubes, but may also be used, inter alia, for low-pressure discharge lamps having four tubes, as used, for example, for the low-pressure discharge lamp OSRAM DULUX D/E, or may also be used for those having eight or more (n) tubes. In contrast to the embodiments shown in FIGS. 1 and 2, n/2 cross connections and (n/2)−1 web attachments are provided. The wires 5 and 50 are provided in the same manner outside the tubes of the discharge vessel or inside said tubes.

With the invention it is also unnecessary for power to be supplied only to the end sections of the discharge vessel. In the same manner, the present invention may also be used for low-pressure discharge lamps having additional electrode holders.

The present invention does not change the electrical parameters of the lamp from those in the solutions according to the prior art for reducing the starting voltage.

The present invention may also be successfully used for reducing the starting voltage if further power supply lines, for example for heating an amalgam, have already been provided on the lamp.

In the case of a low-pressure discharge lamp according to the invention corresponding to the third exemplary embodiment, instead of the wire ring 5 or 50, an electrically conductive powder may be introduced into the base cement of the base housing 10, and contact may be made between said powder and a power supply wire. For example, 15% ferrous powder may be introduced into the base cement.

As an alternative to the third exemplary embodiment, in a low-pressure discharge lamp corresponding to the first exemplary embodiment, electrically conductive powder, preferably ferrous powder, is sprinkled onto the base cement prior to heating. In this case, contact is made between the powder and a power supply wire. In this fourth exemplary embodiment, a reduction in the starting voltage could also be achieved.

In the low-pressure discharge lamp corresponding to the fifth exemplary embodiment, instead of the powder in the third and fourth exemplary embodiments, an electrically conducting layer is provided on the inside of the base housing, and is supplied with power. For this purpose, aluminum foil or an aluminum coating is provided on the inside of the base housing.

Figure 3A:
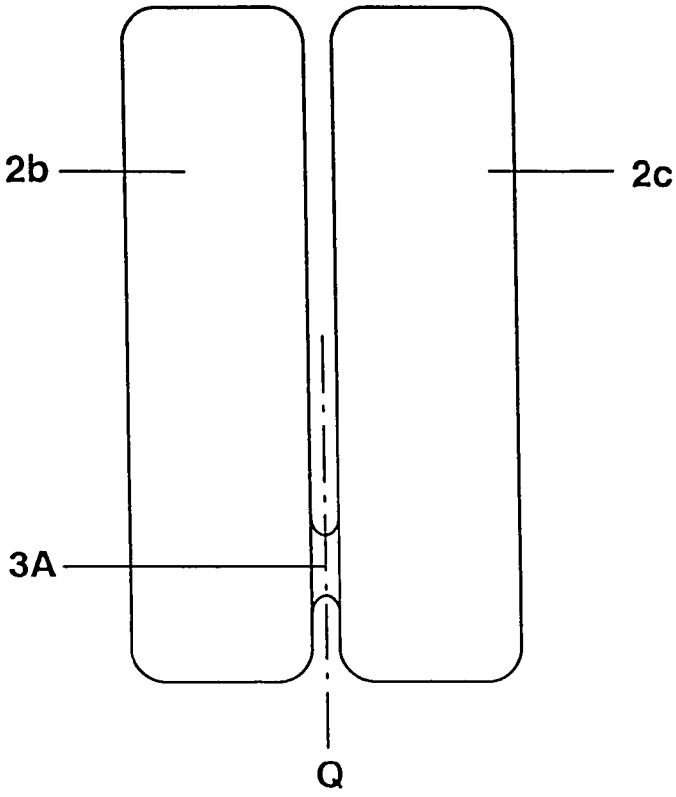
FIGS. 3A and 3B show a schematic representation of the sixth exemplary embodiment.
Figure 3B:
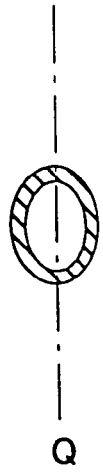

FIGS. 3A and 3B serve the purpose of illustrating a sixth exemplary embodiment corresponding to the present invention.

FIG. 3A shows, schematically, the tubes 2*b* and 2*c* and their connection, at the bottom, with the web attachment 3A. In the same manner, the tubes 2*d* and 2*e* are also connected via the web attachment 3B, and the corresponding tubes in low-pressure discharge lamps are connected to n tubes. FIG. 3B shows an enlarged view of the cross section of the web attachment 3A in the sectional plane Q in FIG. 3A.

Enlarging the cross section of the web attachments 3A reduces the voltage required for starting the lamp. For example, when increasing the cross section of the web from between 9 and 10 $mm^2$ to approximately 24 $mm^2$, the starting voltage could be reduced by approximately 20 V per web attachment.

In this case, an acceleration of the luminous-flux build-up could also be observed. The inventor considers that this effect is a result of the fact that, once the lamp has been started, the mercury vapor can be distributed more rapidly in the lamp with greater cross-sectional areas of the web attachments. On the other hand, the luminous flux itself is not influenced by the cross section of the web attachment.

The temperature in the base housing is approximately 5° C. lower than in the case of standard lamps owing to the reduced losses through the walls in the region of the enlarged web attachments 3A, 3B.

The large web diameter may be achieved, for example, by blowing in a blow mold. In this case, large wall thicknesses of discharge vessels may lead to processing problems, since a relatively large amount of glass needs to be removed in order to produce the web opening. This glass material forms a bead around the web attachment which means that the distance between the tubes 2*b* and 2*c*, and 2*d* and 2*e* needs to be increased. This may lead to the end sections of the tubes 2*a* and 2*f*, in which the electrodes are accommodated, as a result of which these tubes form the ends of the discharge path, being located closer together than in the case of lamps without an enlarged cross section of the web attachments. However, the spacing between the ends of these tubes 2*a* and 2*f* likewise influences the starting voltage of the lamp, and so this needs to be taken into account when reducing the starting voltage by increasing the cross section of the web attachment.

Advantageous values for the cross section of the web, as it is shown in FIG. 3B, are in the range from 19 to 29 $mm^2$, preferably in the range from 22 to 25 $mm^2$. This widening of the cross section of the web attachments reduces the voltage required to transport the initial charging wave along the inside of the discharge tubes from one electrode to the other, since each narrow point along the inside of the tubes is an obstruction for this charge wave. In addition, the spacing between the ends of the tubes 2*a* and 2*f* may be reduced from the standard 2.3 mm to between 1.8 and 0.7 mm. The inventor has assumed that when the electrodes, which are arranged in the ends of the tubes 2*a* and 2*f*, are quite close together, the electron avalanche from the electrodes to the bulb wall is triggered more easily. This may further reduce the required starting voltage.

The sixth exemplary embodiment should not be considered separately from the other exemplary embodiments. Thus, in a low-pressure discharge lamp according to the invention, in addition to the larger cross sections of the web attachments, one or more devices for reducing the starting voltage of the first to fifth exemplary embodiments may be provided, preferably the wires 5 or 50 from the first and second exemplary embodiments. In these combinations, the wire may bring about a reduction in the starting voltage of approximately 100 V, whereas the widening of the webs brings about a reduction in the starting voltage of about 40 V.

A low-pressure discharge lamp is thus described having a base housing, a discharge vessel, whose end sections are fixed to an end section of the base housing, and a contact-making system for making electrical contact with the lamp, which is located on the end section of the base housing which is remote from the discharge vessel, a conductive section being provided, which is electrically connected to the contact-making system and is arranged adjacent to the discharge vessel in the base housing in such a way that an electrical short circuit is formed around the discharge vessel. This makes it possible to reduce the starting voltage of the lamp. As an alternative, or in addition, to this, the cross section of web attachments between tubes of the discharge vessel is increased, which also increases the rate of the luminous-flux run-up.

LIST OF REFERENCE NUMERALS

2 Discharge vessel
2*a*–2*f* Tubes
3A, 3B Web attachments
4A–4C Cross connections
5 Wire
5A Connecting section
5B End section
6,7 Electrode holders
10 Base housing
50 Wire
50A Connecting section
50B End section

What is claimed is:

1. A low-pressure discharge lamp having a base housing, a wound, tubular discharge vessel, whose end sections are fixed to an end section of the base housing, a contact-making system for making electrical contact with the lamp, which is located on the end section of the base housing which is remote from the discharge vessel, and a conductive section, which is electrically connected to the contact-making system and is arranged adjacent to the discharge vessel in the base housing in such a way that an electrical short circuit is formed around at least part of the discharge vessel.

2. The low-pressure discharge lamp as claimed in claim 1, the electrically conductive section having a wire.

3. The low-pressure discharge lamp as claimed in claim 2, at least a section of the wire being provided on the inner circumference of the base housing.

4. The low-pressure discharge lamp as claimed in claim 2, at least a section of the wire being provided on the inner circumference of discharge tubes forming the discharge vessel.

5. The low-pressure discharge lamp as claimed in claim 2, the discharge vessel having at least two tubes, between which the wire is located.

6. The low-pressure discharge lamp as claimed in claim 3, the wire being electrically connected on one side to the contact-making system.

7. The low-pressure discharge lamp as claimed in claim 5, the wire being self-contained.

8. The low-pressure discharge lamp as claimed in claim 1, the electrically conductive section having a conductive layer on the inside of the base housing.

9. The low-pressure discharge lamp as claimed in claim 8, the conductive layer having a metal foil.

10. The low-pressure discharge lamp as claimed in claim 1, the electrically conductive section having an electrically conductive powder in the cement composition of the base housing.

11. The low-pressure discharge lamp as claimed in claim 10, the powder being ferrous powder which has been mixed into the basic composition of the base housing.

12. The low-pressure discharge lamp as claimed in claim 10, the powder being ferrous powder which has been sprinkled onto the basic composition of the base housing prior to heating.

13. The low-pressure discharge lamp as claimed in claim 1, the conductive section being electrically connected to a contact of the contact-making system.

14. The low-pressure discharge lamp as claimed in claim 1, the discharge vessel having at least three U-shaped subelements, and in each case one web attachment being provided for connecting an end section of one of the U-shaped subelements to an end section of the next one of the U-shaped subelements such that a continuous discharge path is formed in the subelements, and the cross-sectional area of the web attachments is chosen such that the starting voltage of the lamp is minimized.

15. The low-pressure discharge lamp as claimed in claim 14, the discharge vessel having three U-shaped subelements and two web attachments.

* * * * *